United States Patent [19]

Lee

[11] Patent Number: 4,975,089

[45] Date of Patent: Dec. 4, 1990

[54] JUMPER CABLE CLAMP FOR CONNECTING CAR BATTERIES

[76] Inventor: Kuo-Shu Lee, 7F, 16, Alley 3, Lane 227, Nung-An Street, Taipei, Taiwan

[21] Appl. No.: 431,042

[22] Filed: Nov. 2, 1989

Related U.S. Application Data

[63] Continuation-in-part of Ser. No. 350,389, May 11, 1989, Pat. No. 4,923,415.

[51] Int. Cl.[5] ..... H01R 4/30

[52] U.S. Cl. ..... 439/755; 439/759; 439/504; 439/506

[58] Field of Search ..... 439/755, 759, 504, 506

[56] References Cited

U.S. PATENT DOCUMENTS

| | | | |
|---|---|---|---|
| 3,267,452 | 8/1966 | Wolf | 439/506 |
| 3,745,516 | 7/1973 | Lieberman | 439/755 |
| 4,345,807 | 8/1982 | Shekel et al. | 439/755 |
| 4,377,317 | 3/1983 | Shekel et al. | 439/755 |
| 4,470,654 | 9/1984 | Friedman | 439/759 |
| 4,565,414 | 1/1986 | French | 439/755 |
| 4,620,767 | 11/1986 | Woolf | 439/755 |
| 4,758,188 | 7/1988 | Yates | 439/759 |
| 4,759,728 | 7/1988 | Cobb | 439/504 |
| 4,897,044 | 1/1990 | Rood | 439/504 |

*Primary Examiner*—Paula A. Bradley
*Attorney, Agent, or Firm*—Ladas & Parry

[57] ABSTRACT

A jumper cable clamp to connect car batteries which includes a conventional terminal clamp having received therein a conductive expansion clip connected to an indication lamp. The conductive expansion clip may be pulled out and firmly retained by the resilient projections of a clip holder set in the clamp, such that the expansion clip is served to clip on the battery terminal. The indications lamp will be turned on to give a warning signal if the expansion clip is secured to the wrong battery terminal.

1 Claim, 6 Drawing Sheets

JUMPER CABLE CLAMP FOR CONNECTING CAR BATTERIES

CROSS REFERENCE TO RELATED APPLICATIONS

The present application is a continuation-in-part of U.S. patent application Ser. No. 07/350,389, filed May 11, 1989, now U.S. Pat. No. 4,923,415, the disclosure of which is hereby incorporated herein by this reference.

BACKGROUND OF THE INVENTION

The automobile is one of the most important means for transportation and has been popularly used everywhere by people. It is indeed vary embarrassing that one's car is out of order while driving. Among various possible troubles, battery failure is most commonly encountered. More particularly in the cold weather, the low voltage of a battery power can be insufficient to start a car. The most convenient way to charge up a car battery under emergent condition is to use a jumper cable to connect the battery in question to the battery of other car. Therefore, the jumper cable has become one of the requisite tools a car driver has to have on hand.

However, following technology development, the structure of car engine system is getting more compact. Every vehicle designer is trying to fully utilize the limited space of a car. As a consequence, the car battery is also being designed to match with the change of the mechanical structure of a car. In order to minimize space consumption or for other related reasons, more and more battery terminals are to be set on the lateral side of the battery. And this type of battery is set in an engine room, it is normally set to be close to other component parts. However, conventional booster cable clamps are either not very convenient for use to clamp or can not clamp on this type of said mounted battery terminals when the battery is set in the engine room.

SUMMARY OF THE INVENTION

The present invention is related to a jumper cable clamp to connect car batteries. In the specification of Ser. No. 07/350,389 which was filed on 05/11/89 and has been examined patentable, the present invention discloses a kind of jumper cable clamp to connect car batteries, in which a conductive charging clip is used to clip on the battery terminals which are set at the lateral side of a battery, and a polarity indicator means and/or a buzzer are used to provide warning signal if the clamp is secured to the wrong battery terminal. The present invention is another form of convenient and error-free jumper cable clamp which includes a conductive expansion chip for use to clip on the battery terminals which are set at the lateral side of a battery. When the clip is not in use, it can be automatically pulled back by a pull back spring. The conductive expansion clip further connect an indication lamp to an electric wire connector, such that the indication lamp is turned on when jumper cable clamps are erroneously clamping on battery terminals.

DETAILED DESCRIPTION OF THE PREFERRED EMBODIMENT

Figure 1:
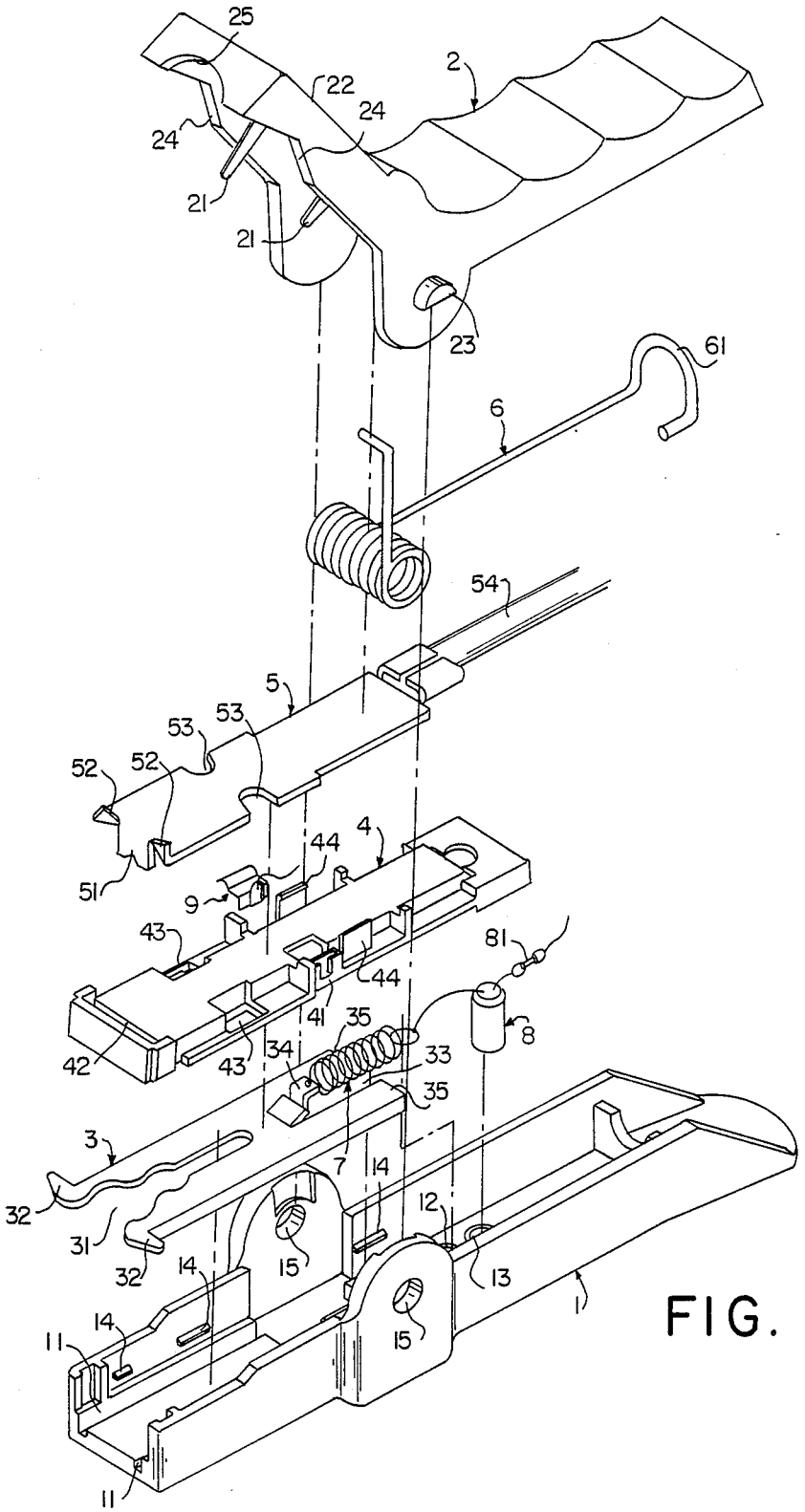
FIG. 1 is a perspective exploded view of a jumper cable clamp embodying the present invention.
Figure 2:
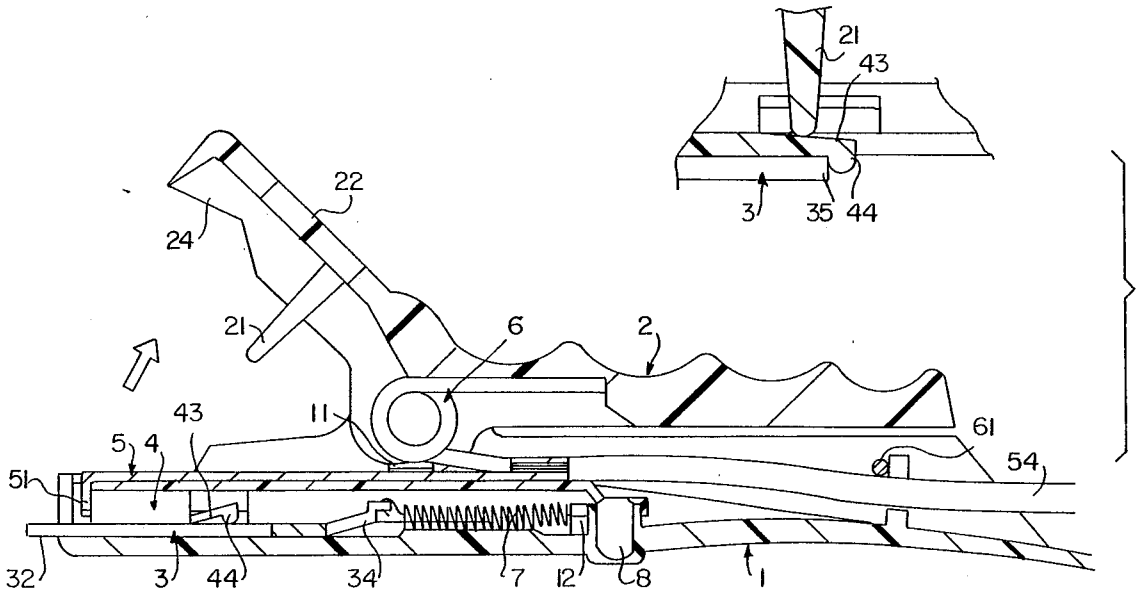
FIG. 2 is a sectional elevation of the present invention.

Turning now to the annexed drawing in detail and first referring to FIGS. 1 and 2, therein illustrated is a jumper cable clamp embodying the present invention and generally comprised of a fixed clamping element (1) made of plastic material, a movable clamping element (2), an expansion clip (3), a clip holder (4), an electric wire connector (5), a return spring (6), a pull back spring (7), an indication lamp (8) and a conductive spring plate (9).

The fixed clamping element (1) has a sliding way (11) for setting therein of the expansion clip (3). The expansion clip (3) has two front holding ends (32) defining therebetween a front opening (31), a back opening (33), and a retaining member (34) curvilinearly raising from the back opening (33) to hold the pull back spring (7) from one end. The pull back spring (7) has its other end fixedly secured to a post (12), which is made on the inner bottom of the fixed clamping element (1), and series connected to a resistor (81) through the indication lamp (8), which resistor (81) is further connected to the conductive spring plate (9). The conductive spring plate (9) is seated in a slot (41) made on the clip holder (4). The indication lamp (8) is further positioned in a slot (13) made on the fixed clamping element (1). The fixed clamping element (1) further comprises a plurality of convex strips (14) bilaterally on its inner side wall to secure the clip holder (4) when the clip holder (4) is placed in the sliding way (11) of the fixed clamping element (1) above the expansion clip (3).

The clip holder (4) has a front notch (42) into which the front hook end (51) of the electric wire connector (5) is inserted. When the expansion clip (3) is pulled out for operation, the front hook end (51) of the electric wire connector (5) comes in connect with the retaining member (34) of the expansion clip (3). Under this condition, the movable clamping element (2) may be pressed down letting the semicircular end (25) force the two raised ends (52) of the electric wire connector (5) to move downward to further push the front hook end (51) of the electric wire connector (5) to engage with the retaining member (34) of the expansion clip (3). Thus, electric power can be stably connected to the expansion clip (3). Two resilient projections (43) are made on the clip holder (4) at both sides, which can resiliently retain the rear end (35) of the expansion clip (3) when the expansion clip (3) is pulled out from the sliding way (11)

of the fixed clamping element (1). The movable clamping element (2) comprises two projecting rods (21) downwardly extending from its head portion (22), which two projecting rods (21) may be pressed down to force the two resilient projections (43) to firmly retain the rear end (35) of the expansion clip (3) when it is required. Two unitary retaining portions (44) are made on the clip holder (4) at both lateral sides to retain the electric wire connector (5) when the electric wire connector (5) is mounted on the clip holder (4). As stated, the indication lamp (8) is positioned in the slot (13) of the fixed clamping element (1), when the electric wire connector (5) is placed on the clip holder (4) and retained by the retaining portions (44), the electric wire connector (5) comes to connect with the indication lamp (8), via the conductive spring plate (9), for checking the polarity of battery terminal.

The electric wire connector (5) is connected with an electric wire (54), and comprises, in addition to the front hook end (51) and the two raised ends (52), two opposite notches (53) for passing therethrough of the two projecting rods (21) of the movable clamping element (2).

The return spring (6) includes a hook end (61). During assembly, the return spring (6) is set between the movable clamping element (2) and the electric wire connector (5) with its hook end (61) firmly holding up the electric wire (54).

In addition to the two projecting rods (21) and the semicircular end (25), the movable clamping element (2) further comprises two unitary tenons (23) and two tooth spaces (24) disposed at both sides, wherein the unitary tenons (23) are for connection with the two positioning holes (15) of the fixed clamping element (1), and the tooth spaces (24) are for clamping battery terminal. During assembly, the two unitary tenons (23) are respectively set in the two positioning holes (15) of the fixed clamping element (1), such that the movable clamping element (2) and the fixed clamping element (1) form into a clamp.

Figure 3:
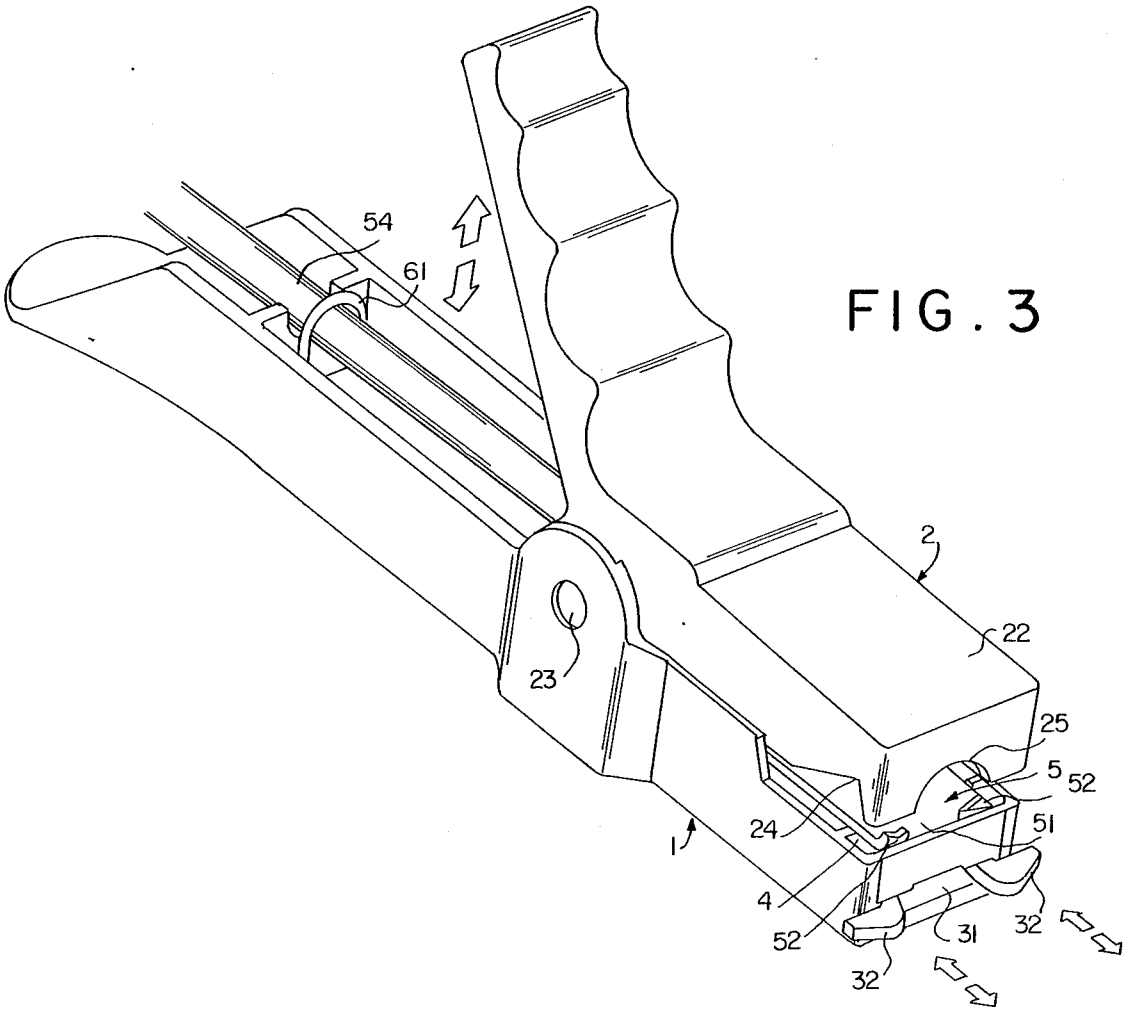
FIG. 3 is a schematic drawing of the present invention wherein the expansion clip is retreated inside the clamp.
Figure 4:
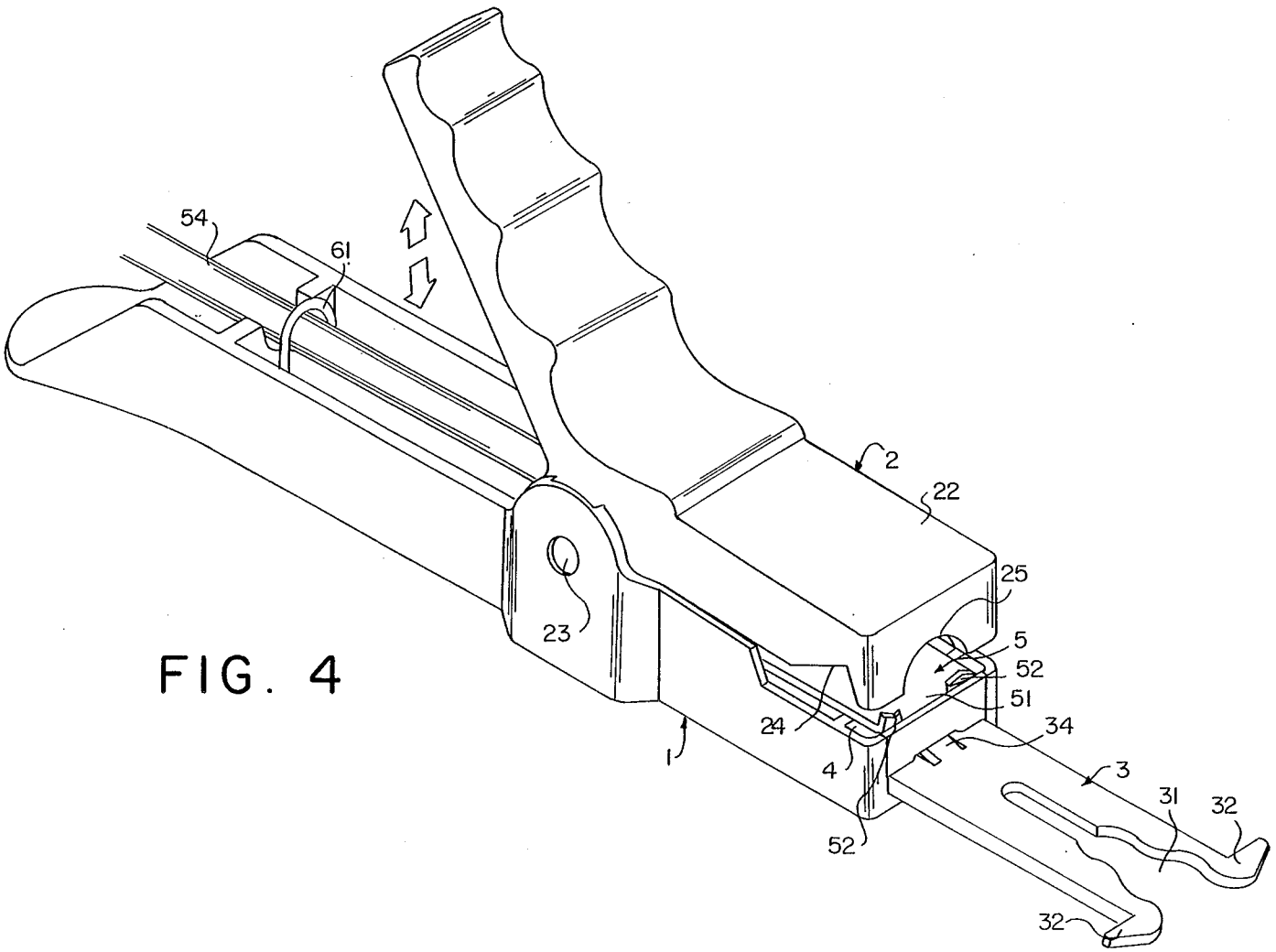
FIG. 4 is a schematic drawing of the present invention wherein the expansion clip is pulled out for operation.
Figure 6:
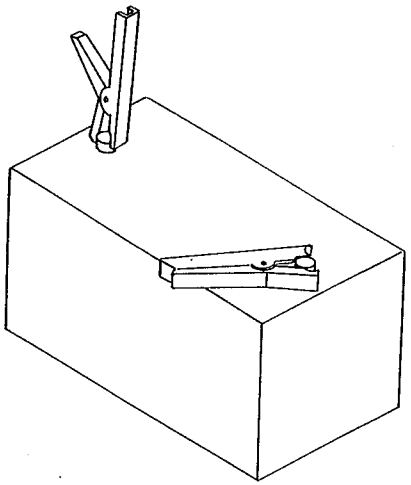
FIG. 6 is a schematic drawing of the present invention applied to clamp on a top mounted battery terminal by means of the clamping elements.
Figure 5:
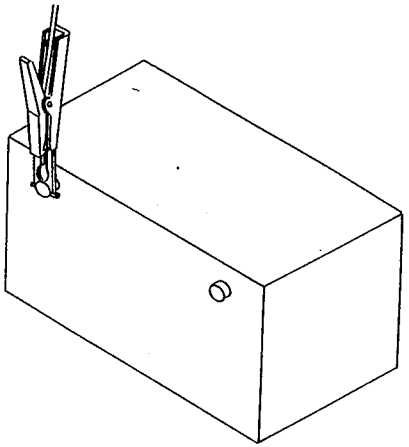
FIG. 5 is a schematic drawing of the present invention applied to clip on a side mounted battery terminal by means of the expansion clip.

Referring to FIGS. 3 and 4, when the expansion clip (3) is in use, the movable clamping element (2) is pressed down to lift the head portion (22) so that the two projecting rods (21) can leave from the resilient projections (43), and the expansion clip (3) can be pulled out from the sliding way (11). After the rear end (35) of the expansion clip (3) is retained by the resilient projections (43), the movable clamping element (2) is released. Through the effect of the return spring (6), the two projecting rods (21) of the movable clamping element (2) are forced to firmly press on the resilient projections (43) to prohibit the expansion clip (3) from retreating back. Thus, the front opening (31) of the expansion clip (3) can be used to clamp on a battery terminal (see FIG. 5). When the expansion clip (3) is not in use, the movable clamping element (2) is pressed down again to separate the two projecting rods (21) from the resilient projections (43), thus, the expansion clip (3) can be pulled back into the sliding way (11) by the pull back spring (7). Further, the raised ends (52) of the electric wire connector (5) may be used to match with the semicircular end (25) or the two tooth spaces (24) of the movable clamping element (2) to vertically or horizontally clamp on a battery terminal (see FIG. 6).

Figure 7:
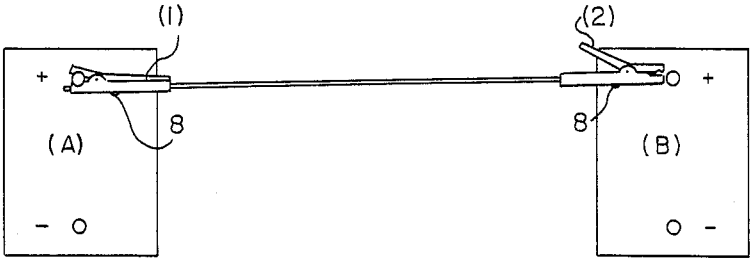
FIG. 7 is a schematic drawing, illustrating two jumper cable clamps of the present invention are correctly clamping on the respective positive terminals of two separate batteries.
Figure 8:
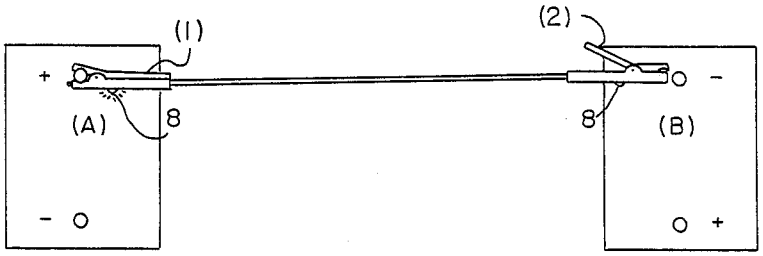
FIG. 8 is a schematic drawing, illustrating two jumper cable clamps of the present invention are erroneously clamping on two battery terminals.

FIGS. 7 and 8 illustrate application of the present invention to connect one battery to another. When a first terminal clamp (1) is clamped on the positive or negative terminal of a battery A, the holding ends (32) of the expansion clip (3) of a second terminal clamp (2) of the same cable is set to connect with the positive or negative terminal of a battery B. In case the indication lamp (8) is not turned on, it means that correct connection is achieved (as shown in FIG. 7). If the indication lamp (8) is turned on, it indicates that the operator has inadvertently connected the clamp to the wrong battery terminal (as shown in FIG. 8). Therefore, by means of this test process, possible battery explosion or other accidents can be eliminated.

What is claimed is:

1. A jumper cable clamp, including:

a fixed clamping element made of plastic material and comprising two-side wall portions upstanding from the bottom defining therebetween a sliding way, a post and a slot on said sliding way, a plurality of convex strips and a pair of positioning holes on said side wall portions;

an expansion clip comprising two holding ends at the front defining therebetween a front opening, a back opening at the rear end, a retaining member curvilinearly raising from said back opening, said expansion clip being set in said sliding way;

a pull back spring having one end connected to said retaining member of said expansion clip and the other end connected to said post of said fixed clamping element;

a clip holder comprising a slot having seated therein a conductive spring plate, a front notch, a pair of resilient projections and a pair of retaining portions at its both sides;

an electric wire connector connected with an electric wire, and comprising two raised ends at the front, a front hook end, and a pair of notches, said front hook end being inserted into the front notch of said clip holder;

an indication lamp and a resistor being received in the slot of said fixed clamping element and connected between said pull back spring and said conductive spring plate;

a movable clamping element movably connected with said fixed clamping element and comprising a pair of projecting rods constantly pressing on the resilient projections of said clip holder; and a return spring set between said movable clamping element and said electric wire connector, and comprising a hook end to retain the electric wire of said electric wire connector, characterized in that said movable clamping element is pressed down to lift said two projecting rods from said resilient projections permitting protrusion of said expansion clip from said sliding way of said fixed clamping element for use, and the rear end of said expansion clip becomes firmly retained by said resilient projections of said clip holder, through the effect of said projection rods of said movable clamping element, upon release of said movable clamping element.

* * * * *